US010633930B2

(12) United States Patent
Hudson et al.

(10) Patent No.: US 10,633,930 B2
(45) Date of Patent: Apr. 28, 2020

(54) PLATFORM BASED DRILL CAPABLE OF NEGATIVE ANGLE DRILLING

(71) Applicant: Caterpillar Global Mining Equipment LLC, Denison, TX (US)

(72) Inventors: Charles Taylor Hudson, Sherman, TX (US); Richard James LaReau, Decatur, IL (US); Gregory Scott, Littleton, CO (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 212 days.

(21) Appl. No.: 15/846,842

(22) Filed: Dec. 19, 2017

(65) Prior Publication Data

US 2019/0186207 A1 Jun. 20, 2019

(51) Int. Cl.

| | |
|---|---|
| ***E21B 15/04*** | (2006.01) |
| ***E21B 7/02*** | (2006.01) |
| ***E21B 15/00*** | (2006.01) |
| ***E21B 7/04*** | (2006.01) |

(52) U.S. Cl.

CPC ..... *E21B 15/003* (2013.01); *E21B 7/025* (2013.01); *E21B 7/04* (2013.01); *E21B 15/04* (2013.01); *E21B 7/02* (2013.01)

(58) Field of Classification Search

CPC ..... E21B 15/003; E21B 15/04; E21B 15/045
See application file for complete search history.

(56) References Cited

U.S. PATENT DOCUMENTS

| | | | | |
|---|---|---|---|---|
| 3,181,630 A | | 5/1965 | Coburn | |
| 3,529,679 A | | 9/1970 | Leven | |
| 3,721,304 A | | 3/1973 | Hanson | |
| 3,919,816 A | | 11/1975 | Ranft | |
| 4,371,046 A | | 2/1983 | Read | |
| 4,606,155 A | * | 8/1986 | Bukovitz | E04H 12/34 173/193 |
| 4,627,499 A | | 12/1986 | Magee et al. | |
| 8,122,974 B2 | | 2/2012 | Kosoric | |
| 8,671,626 B1 | | 3/2014 | Marty et al. | |
| 9,719,271 B2 | | 8/2017 | Trevithick et al. | |
| 2008/0210469 A1 | | 9/2008 | Volkel et al. | |

(Continued)

FOREIGN PATENT DOCUMENTS

| | | |
|---|---|---|
| EP | 2982829 | 2/2016 |
| WO | 2010033935 | 3/2010 |

OTHER PUBLICATIONS

Gonzalez Gonzalez, Pipe Management System for Negative Angle Drilling; U.S. Patent Application filed Dec. 19, 2017; 27 pages.

*Primary Examiner* — Giovanna C Wright

(74) *Attorney, Agent, or Firm* — Oblon, McClelland, Maier & Neustadt

(57) ABSTRACT

A platform based drill includes a drilling platform including a frame structure with first and second opposite ends, and first and second opposite sides. A mast supported on a pivotal connection to the drilling platform adjacent the first end of the frame structure and including an upper portion extending above the pivotal connection, and a lower portion extending below the pivotal connection. An adjusting mechanism permits the mast to be pivotally adjusted to a negative drilling angle whereby the upper portion of the mast leans in a direction extending away from the second end and toward the first end.

20 Claims, 10 Drawing Sheets

(56) References Cited

U.S. PATENT DOCUMENTS

| | | | | |
|---|---|---|---|---|
| 2011/0162296 | A1* | 7/2011 | Benson | E21B 7/02 52/116 |
| 2013/0062126 | A1 | 3/2013 | Thorne | |
| 2017/0191319 | A1 | 7/2017 | Gonzalez et al. | |

* cited by examiner

PLATFORM BASED DRILL CAPABLE OF NEGATIVE ANGLE DRILLING

TECHNICAL FIELD

The present disclosure is directed to a platform based drill and, more particularly, is directed to a platform based drill capable of negative angle drilling.

BACKGROUND

Excavating is employed to create mines, quarries, etc., in order to obtain desirable material such as ore or stone. In addition to using various types of heavy excavating equipment, drill-and-blast operations are commonly used to fragment material so it can be loaded and hauled. For example, overburden may need to be removed in order to reach the desirable material. Also, once the desirable material is reached, production ore may be removed to be crushed or milled to an acceptable grade. In an open pit mine, drill-and-blast operations may include drilling different types of blast holes. For example, such operations may include drilling production holes, buffer holes, and pre-split holes. These blast holes may be drilled on a work surface designated a "bench" below a sloped surface referred to as a "highwall."

Production holes are typically vertical, although they also may be at an angle, while pre-split holes are typically at an angle that aligns with the slope of the highwall, for example 5 to 15 degrees from vertical and near to the base of the highwall. In addition, production holes typically are larger in diameter than pre-split holes. Production holes are usually bored by a platform based rotary blast hole drill with a mast at one end of the platform. While a typical platform based drill may be able to drill holes at a positive angle by tilting the mast from a machine vertical position to an angular position with the upper portion of the mast leaning back toward the end of the platform opposite the drill end, it is not capable of achieving a desired negative angle (i.e., tilting the mast away from the end of the platform opposite the drill) for drilling pre-split near the highwall base which would require the drilling end of the machine to be positioned against the highwall.

Current drill-and-blast operations employ platform based drills to bore the typically larger production holes, but not for boring the typically smaller pre-split holes. Pre-split holes are formed close to the highwall and substantially at the angle of the highwall in order to maintain the desired slope of the highwall as the depth of the bench is increased and the height of the highwall is increased. Since platform based drills are not capable of drilling at the required angle of the highwall near the base of the highwall, the usual drill-and-blast operation will employ various dedicated pre-split drills that are usually boom mounted drills. Accordingly, a drill-and-blast operation in an open pit mine ordinarily may require a diverse fleet of drilling machines in order to form the different types of required holes.

There exists a need for a more universal platform based drill. It would be both beneficial and desirable to provide a platform based drill that is capable of boring both vertical and positive angle production hole, and also is capable of boring angle pre-split holes in close proximity to the highwall. In this way, among other advantages, the requirement for securing diverse types of drilling equipment at a mine site may be substantially reduced resulting in a substantial cost advantage. In other words the various types of blast holes, such as production holes, buffer holes, and negative angle pre-split holes, advantageously may be drilled by a single type of drilling machine.

One type of drilling machine used for drill-and-blast operations is disclosed in U.S. Pat. No. 3,181,630 issued to Coburn on May 4, 1965 ("the '630 patent"). The '630 patent discloses a self-propelled rotary blast hole drilling machine wherein a mobile base is rotatably supported at its central portion on a crawler support frame. In a drilling operation, the base is supported by three spaced hydraulic leveling jacks for leveling and supporting the base. The '630 patent includes an elongated one-piece derrick unit pivotally mounted at its lower end to a forward portion of the base. The derrick is supported on the base such that the derrick may be located in either a vertical position for drilling vertical holes, or in an inclined position for drilling angle holes.

While the drilling machine of the '630 patent may be useful for vertical drilling and, to some extent, angle drilling, it lacks the capability to drill blast holes, such as pre-split holes, at a negative angle in close proximity to a sloping highwall. In fact, the drilling machine of the '630 patent is not capable of drilling at a negative angle at all. The '630 patent does disclose, in FIG. 1 and the accompanying description thereof, that the derrick may be inclined via a hydraulic cylinder for drilling blast holes at an angle to the vertical. However, the inclination is such that the top portion of the derrick is moved toward the non-drilling side of the drilling machine, with the drill itself and the borehole angling away from the drilling machine. In other words, the machine of the '630 patent may drill holes at a positive angle, but is not capable of drilling holes at a negative angle, either in close proximity to a highwall or otherwise.

The disclosed platform based drill capable of negative angle drilling of the present disclosure solves one or more of the problems set forth above and/or other problems of the prior art.

SUMMARY

In one aspect, the present disclosure is directed to a platform based drill. The platform based drill may include a drilling platform including a frame structure having a first end, a second end opposite the first end, and first and second opposite sides. The platform based drill also may include a mast supported on a pivotal connection to the drilling platform adjacent the first end of the frame structure and including an upper portion extending above the pivotal connection, and a lower portion extending below the pivotal connection. The platform based drill also may include an adjusting mechanism configured to permit the mast to be pivotally adjusted to a negative drilling angle whereby the upper portion of the mast leans in a direction extending away from the second end of the frame structure and toward the first end of the frame structure.

In another aspect, the present disclosure also is directed to a platform based drill. The platform based drill may include a drilling platform including a frame structure having a first end, a second end, a first side, and a second side. The platform based drill also may include an opening within the frame structure at the first end centrally between the first side and the second side and extending into the drilling platform. The platform based drill also may include a mast extending within the opening and including an upper portion and a lower portion. The platform based drill also may include an adjusting mechanism configured to permit adjustment of the mast to a negative drilling angle whereby the upper portion of the mast leans in a direction extending away from the second end of the frame structure and toward the first end of the frame structure, the adjusting mechanism including first and second adjustment plates within the opening and fixed to the frame structure. The platform based drill also may include a pivotal connection between the mast and the first and second adjustment plates.

In yet another aspect, the present disclosure is directed to a method of drilling with a platform based drill, the platform based drill including a frame structure with a pivotable mast mounted at one end of the frame structure. The method may include positioning the platform based drill on a bench surface of an excavation with the one end of the frame structure at a first distance from a highwall of the excavation and with the pivotable mast adjacent the highwall, the highwall including a face sloping at an angle to vertical. The method also may include pivoting the mast to achieve a negative angle from machine vertical with the mast extending substantially parallel to the face of the highwall. The method also may include drilling a series of pre-split holes in the bench surface adjacent the highwall at substantially the same angle to vertical as the angle of the face of the highwall. The method also may include positioning the platform based drill on the bench surface of the excavation at a second distance from the highwall different from the first distance. The method also may include drilling a series of production holes in the bench.

DETAILED DESCRIPTION

In referring to the several views illustrated in FIGS. 1-10, terms denoting spatial relationships such as "ends," "sides," "above," "below," "upper," "upwardly," "lower," "downwardly," etc., have been employed in the conventional frame of reference with respect to horizontal and vertical and in the conventional sense relative to the normal substantially horizontal working orientation of platform based drilling equipment. Use of the terms "substantially" or "generally" within this specification, (e.g., substantially parallel, generally planar, etc.) is intended to take into account those situations wherein the components and relationships referenced may deviate from an absolute by normal and accepted industry manufacturing tolerances or industry field tolerances.

Also in this disclosure and in referring to the several views, the term "bench" is employed to designate the portion of an excavation which may currently be the working surface to be excavated via drilling and blasting, and the "bench surface" is employed to designate the actual surface of the bench upon which a platform based drill or other equipment may be supported. The term "highwall" is employed to designate a surface extending above the bench and typically at an acute angle to vertical such that the highwall forms an obtuse angle with the bench surface. The term "negative angle" is employed to designate an angle of a mast of a drilling machine relative to machine vertical wherein the upper end of the mast leans away from, or outbound of, the drilling machine in a direction away from the non-drilling end of the platform and the lower end of the mast below the mast pivot connection is inclined toward, or inbound of, the drilling machine. A "platform based drill" is employed to designate that category of drilling machine that includes a generally planar structure or platform supporting a mast as opposed to boom mounted drilling equipment.

Figure 1:
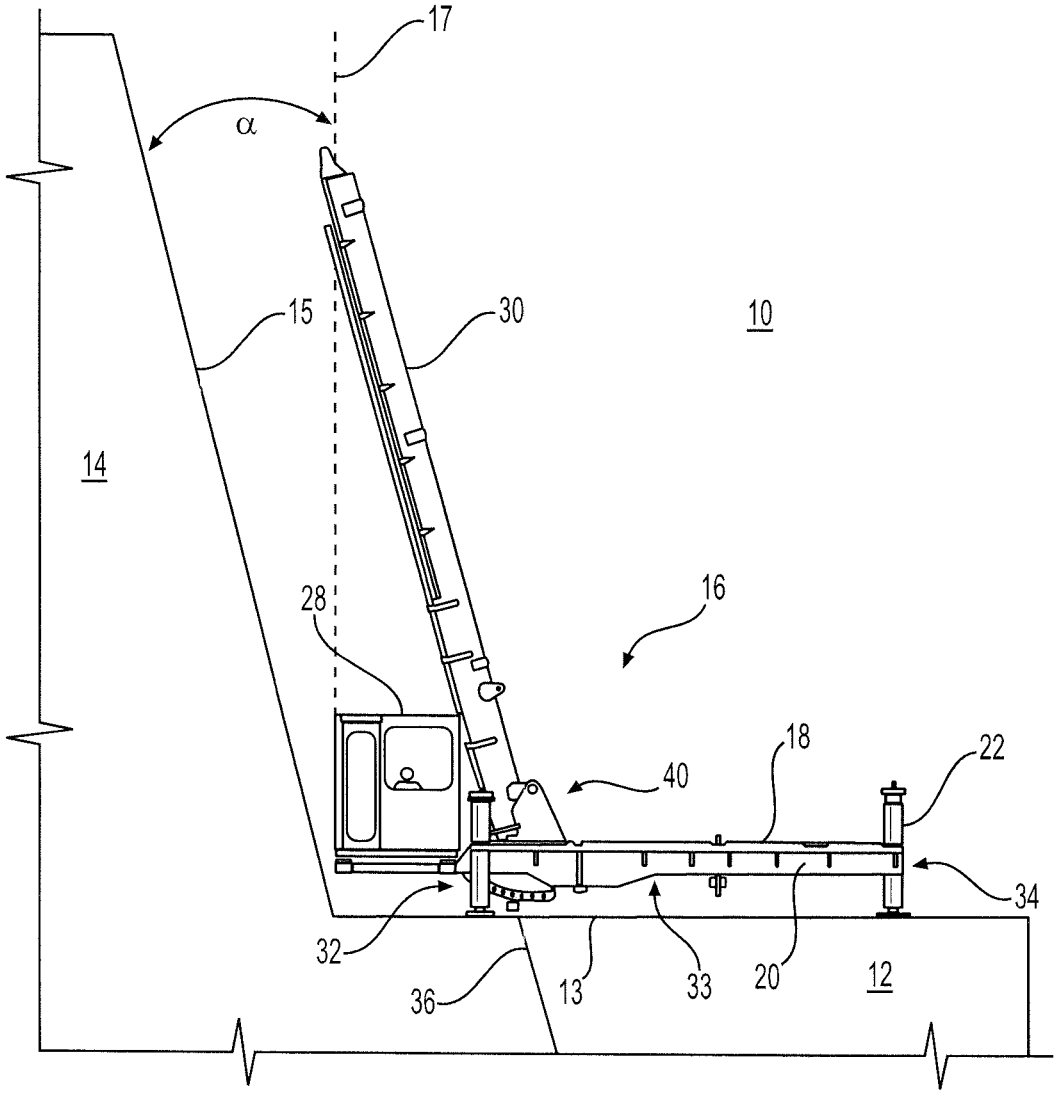
FIG. 1 illustrates an exemplary platform based drill supported on a bench adjacent a highwall of a mine or quarry.

FIG. 1 illustrates certain aspects of the disclosure including one environment in which the disclosed machine may be employed and in which the disclosed method may be realized. The environment illustrated in FIG. 1 is that of an excavation 10, such as an open pit mine, quarry, etc. Such an excavation 10 commonly is formed by a combination of excavating and haulage techniques with various types of excavating machines and haulage vehicles, and drill-and-blast techniques using drilling machines and explosives. At the various levels reached in the course of formation of excavation 10, the surface on which working equipment rests may be designated a bench 12, and an adjacent wall of the excavation 10 rising above the bench 12 may be designated a highwall 14. For purposes of this disclosure, bench 12 may be said to include a bench surface 13, and highwall 14 may be said to include a face 15. Face 15 typically may form an obtuse angle with bench surface 13, and face 15 typically may slope at an acute angle $\alpha$ relative to vertical 17.

Diagrammatically illustrated in FIG. 1 is a stripped-down version of a platform based drill 16 showing only certain basic components. Platform based drill 16 may include a drilling platform 18 which in turn may include, among other things that are not illustrated in FIG. 1, a frame structure 20. Drilling platform 18 may be supported and leveled, for example during a drilling operation, by a plurality of vertically adjustable supports, such as vertically adjustable support 22. Platform based drill 16 also may include an operator station 28 which may house suitable controls and provide accommodations for personnel. Platform based drill 16 also may include a mast 30 for supporting drilling equipment. Frame structure 20 may include a first end 32 and a second end 34 that is opposite first end 32. In addition, frame structure 20 may include two opposite sides, the view in FIG. 1 showing first side 33. Both operator station 28 and mast 30 may be located adjacent first end 32.

During the course of forming excavation 10, bench 12 may be drilled and blasted in order to aid further removal of overburden and/or desirable ore material, for example. A common practice is to attempt to maintain face 15 of highwall 14 at an angle $\alpha$ relative to vertical 17 that is commensurate with maintaining stability of highwall 14. For example, an exemplary angle $\alpha$ of slope for face 15 of highwall 14 may be on the order of 15 degrees from vertical 17. It is contemplated that angle $\alpha$ may be at least 15 degrees, and angles greater than or less than 15 degrees also are contemplated. As illustrated in FIG. 1, mast 30 of platform based drill 16 may be extended to an angle that is substantially parallel to face 15 of highwall 14. In this orientation wherein mast 30 is substantially parallel to face 15 of highwall 14, a series of pre-split holes, such as pre-split hole 36, may be drilled at the angle of face 15 and closely adjacent highwall 14 in order to facilitate blasting and maintaining of face 15 of highwall 14 at a desirably stable angle as excavation proceeds.

Figure 2:
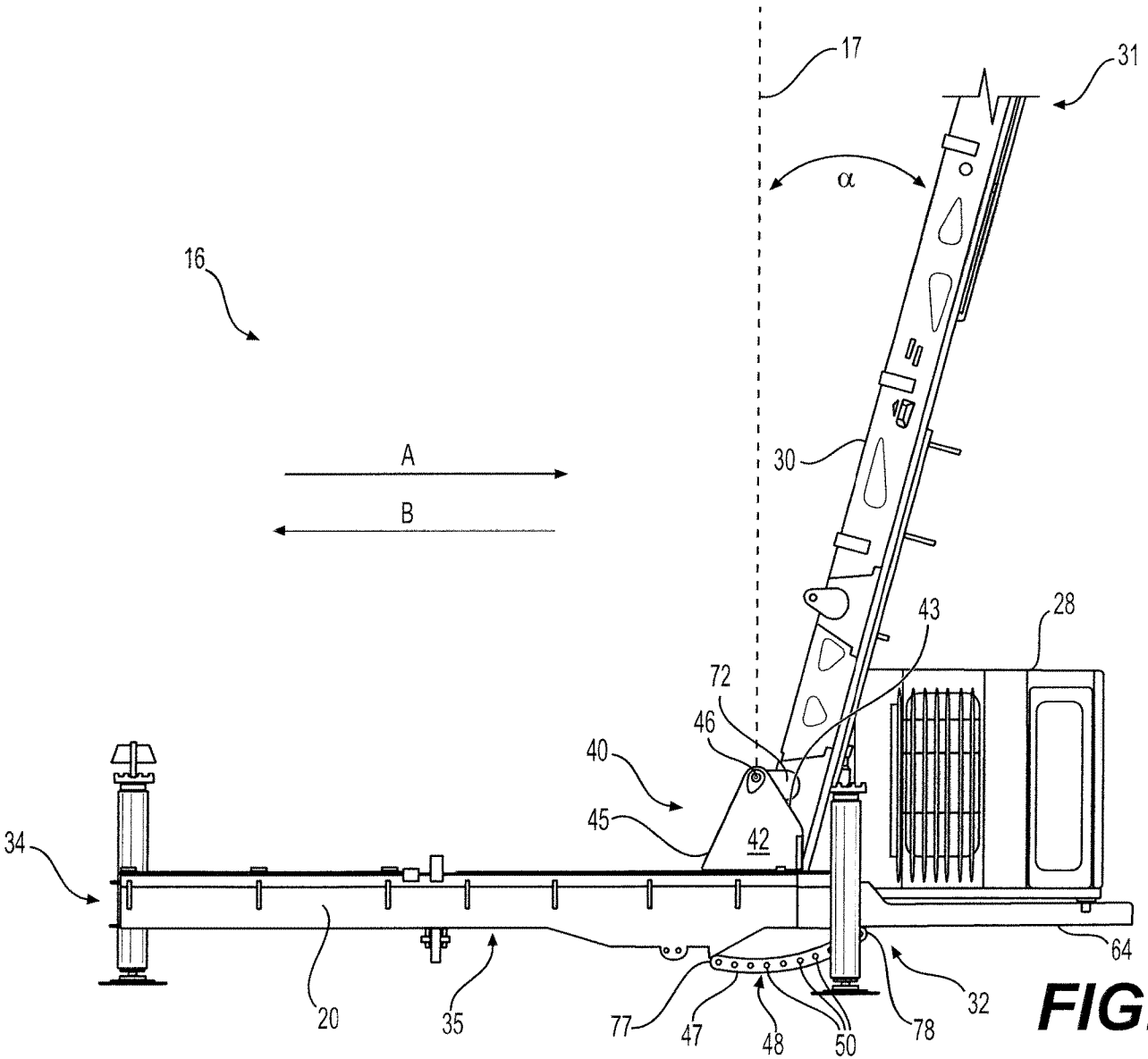
FIG. 2 is a view of an exemplary platform based drill from a side opposite to that illustrated in FIG. 1.

FIG. 2 is another view of platform based drill 16 illustrated in FIG. 1. The view in FIG. 2 shows a second side 35 of frame structure 20 that is opposite first side 33 shown in FIG. 1. In addition to some of the same features illustrated and described in connection with FIG. 1, FIG. 2 generally illustrates an adjusting mechanism 40 configured to permit mast 30 to be adjusted to a negative drilling angle. Adjusting mechanism 40 may include a first adjustment plate 42 visible in FIG. 2. Adjustment plate 42 may be fixed to frame structure 20, for example by welding or using suitable fasteners. Mast 30 may be pivotally mounted relative to adjusting mechanism 40, and thus frame structure 20, via a pivotal connection 46. FIG. 2. also illustrates an arcuate array 48 of adjustment apertures 50 in first adjustment plate 42 which may facilitate locking mast 30, for example via cooperation with suitable structure associated with mast 30 to be described subsequently, at a suitable angle to which it has been pivoted. For example, mast 30 may be locked at a negative angle $\alpha$ of at least 15 degrees relative to vertical 17 with an upper portion 31 of mast 30 extending in the direction A away from second end 34 of frame structure 20 and toward first end 32 of frame structure 20.

Figure 3:
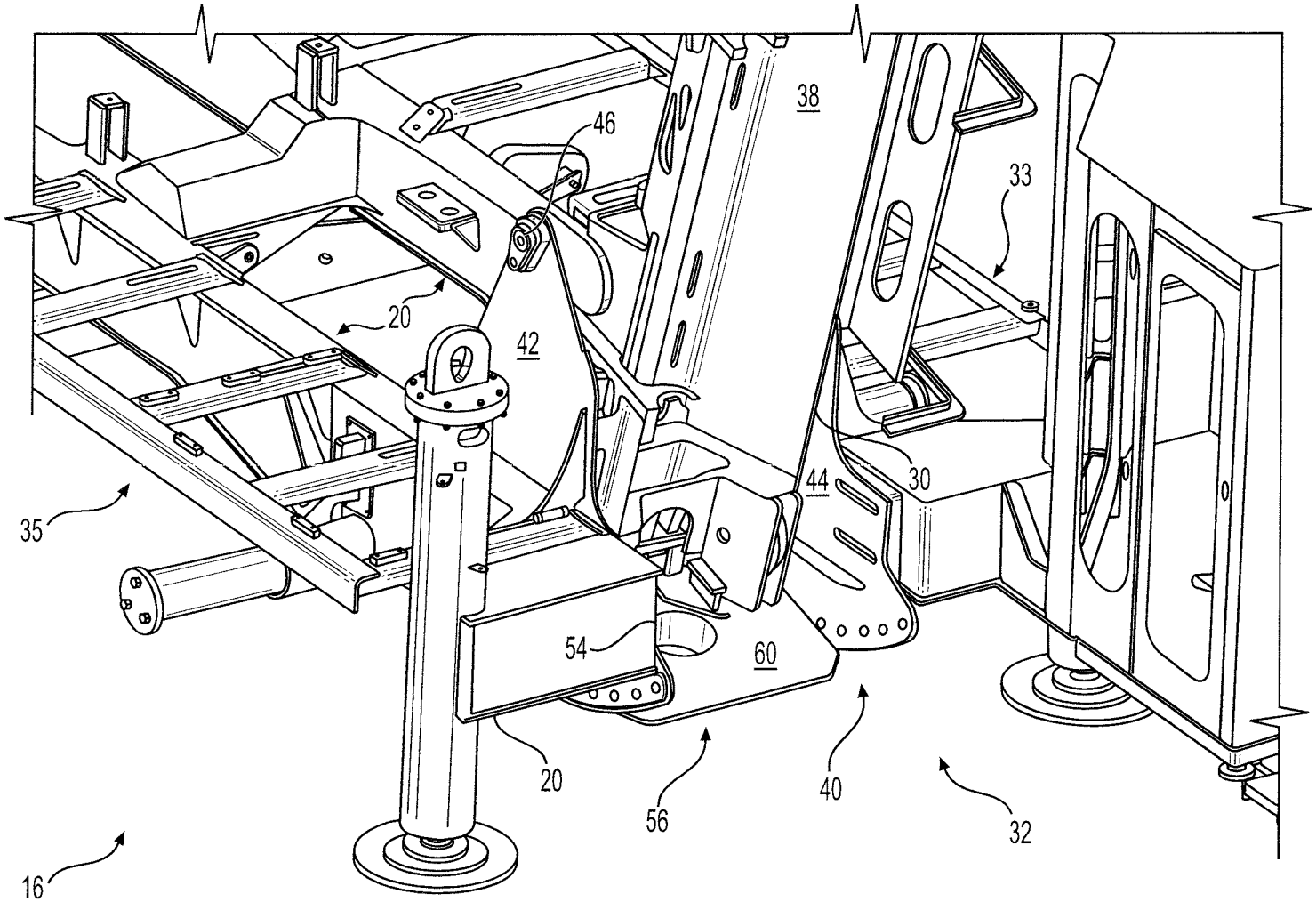
FIG. 3 is a perspective view of certain details of an exemplary platform based drill.

FIG. 3 is a perspective view of platform based drill 16 adjacent first end 32 of frame structure 20 showing a lower portion 56 of mast 30 and showing certain features of platform based drill 16 in greater detail. First end 32 may include an opening 54 within frame structure 20. Opening 54 may be centrally located between first side 33 and second side 35 of frame structure 20. Adjusting mechanism 40 may be mounted to frame structure 20 within opening 54. In addition to first adjustment plate 42 briefly described in connection with FIG. 2, FIG. 3 partially illustrates a second adjustment plate 44 (partially hidden by mast 30), which may be substantially parallel to first adjustment plate 42. Both first and second adjustment plates 42, 44 are mounted to frame structure 20 within opening 54. Opening 54 may include two parallel side edges with one of first and second adjustment plates 42, 44 mounted to one of the two side edges, and the other of first and second adjustment plates 42, 44 mounted to the other of the two side edges. Lower portion 56 of mast 30, including a baseplate 60, may extend to a position between first and second adjustment plates 42, 44. Mast 30 may be pivotably attached to first and second adjustment plates 42, 44 via pivotal connection 46, with only the pivotal connection 46 of first adjustment plate 42 being visible in FIG. 3. Viewing FIGS. 2 and 3 together, for example, it can be seen that mast 30 is supported on pivotal connection 46 to drilling platform 18 adjacent first end 32 of frame structure 20, and includes upper portion 31 extending above pivotal connection 46, and lower portion 56 extending below pivotal connection 46.

Figure 4:
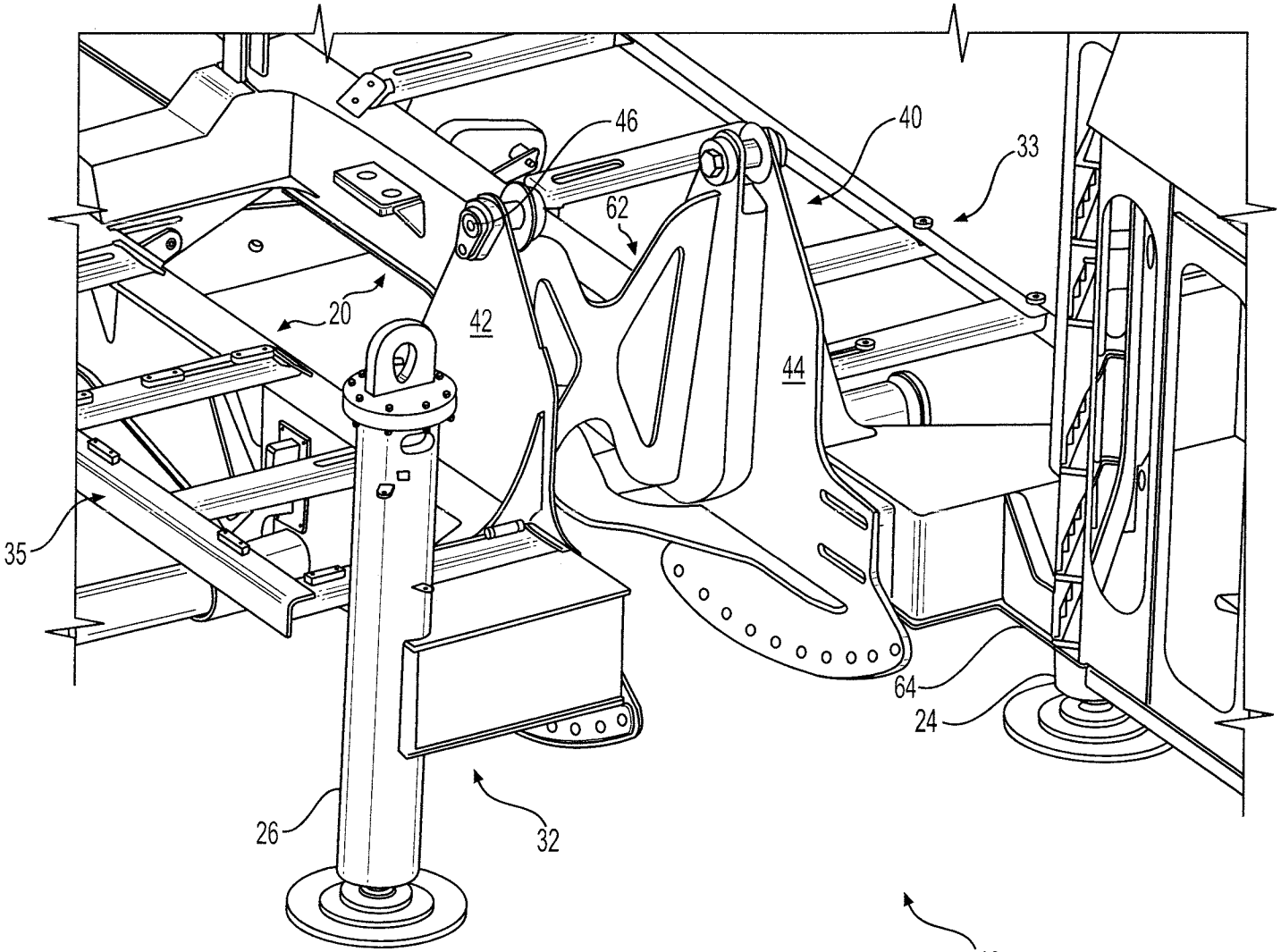
FIG. 4 is a different perspective view of certain details of an exemplary platform based drill.

FIG. 4 illustrates another perspective view of platform based drill 16 adjacent first end 32 of frame structure 20 with mast 30 removed in order to better illustrate features of adjusting mechanism 40. Both first and second adjustment plates 42 and 44 are visible in FIG. 4. A reinforcing framework 62 may extend between first and second adjustment plates 42 and 44. Reinforcing framework 62 may strengthen and reinforce first and second adjustment plates 42 and 44 to support the weight of mast 30 which typically may weigh many tons. Operator Station 28 may be cantilevered from frame structure 20 via a cantilever frame 64 located at first end 32 of frame structure 20 adjacent one of first and second sides 33, 35, for example adjacent first side 33 as illustrated. First end 32 of frame structure 20 also may include vertically adjustable supports 24 and 26 adjacent first and second sides 33 and 35 of frame structure 20, respectively.

Figure 5:
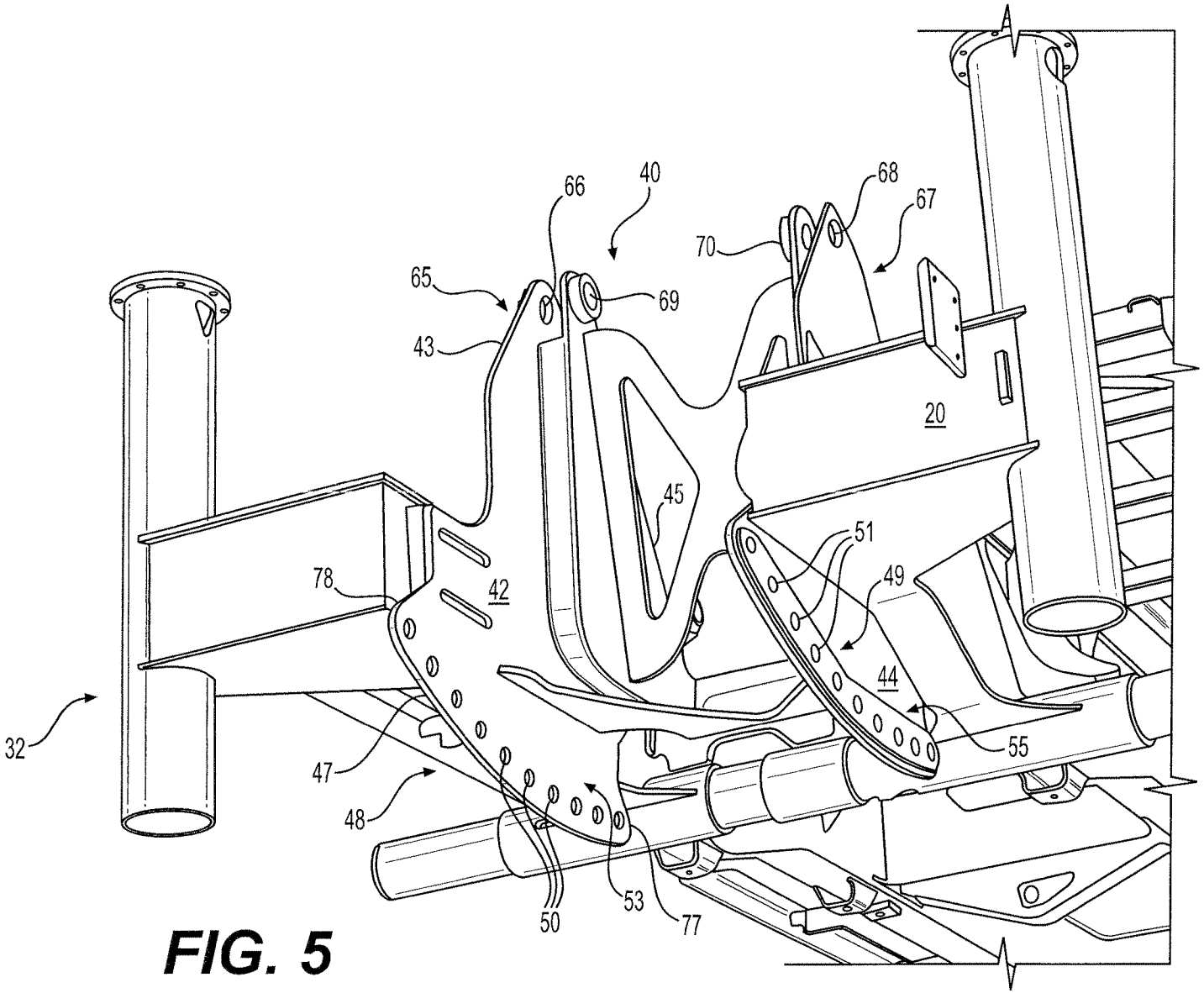
FIG. 5 is another perspective view of certain details of an exemplary platform based drill.

FIG. 5 is another perspective view of first end 32 of frame structure 20 showing aspects of adjusting mechanism 40 when viewed from a position below frame structure 20. Arcuate array 48 of adjustment apertures 50 may be seen in lower portion 53 of first adjustment plate 42, and arcuate array 49 of adjustment apertures 51 may be seen in lower portion 55 of second adjustment plate 44. Upper portion 65 of first adjustment plate 42 may include pivot aperture 66 and upper portion 67 of second adjustment plate 44 may include pivot aperture 68. Along with similar apertures 69, 70 that may be present in reinforcing framework 62, pivot apertures 66, 68 may support pivotal connection 46 (FIG. 3, for example) between mast 30 and adjusting mechanism 40.

Still referring to FIG. 5, first adjustment plate 42 may have a general profile that may include first plate edge 43 and second plate edge 45 converging upwardly to pivot aperture 66. First adjustment plate 42 also may include third plate edge 47 extending between first and second plate edges 43, 45 and including the arcuate array 48 of adjustment apertures extending between a first end 77 of third plate edge 47 and second end 78 of third plate edge 47. Arcuate array 48 may be centered at pivot aperture 66. Pivot apertures 66, 68 of first and second adjustment plates 42, 44 may be above frame structure 20, and arcuate arrays 48, 49 of adjustment apertures 50, 51, of first and second adjustment plates 42, 44, may be below frame structure 20. Whereas a general profile has been describe with reference to adjustment plate 42, it should be understood and it is contemplated that second adjustment plate 44 may have a similar profile that is substantially a mirror image of the profile of first adjustment plate 42. First, second, and third plate edges 43, 45, and 47 also may be seen in FIG. 2 wherein mast 30 is illustrated as inclined to vertical 17 at negative angle $\alpha$ which may be at least 15 degrees.

Figure 6:
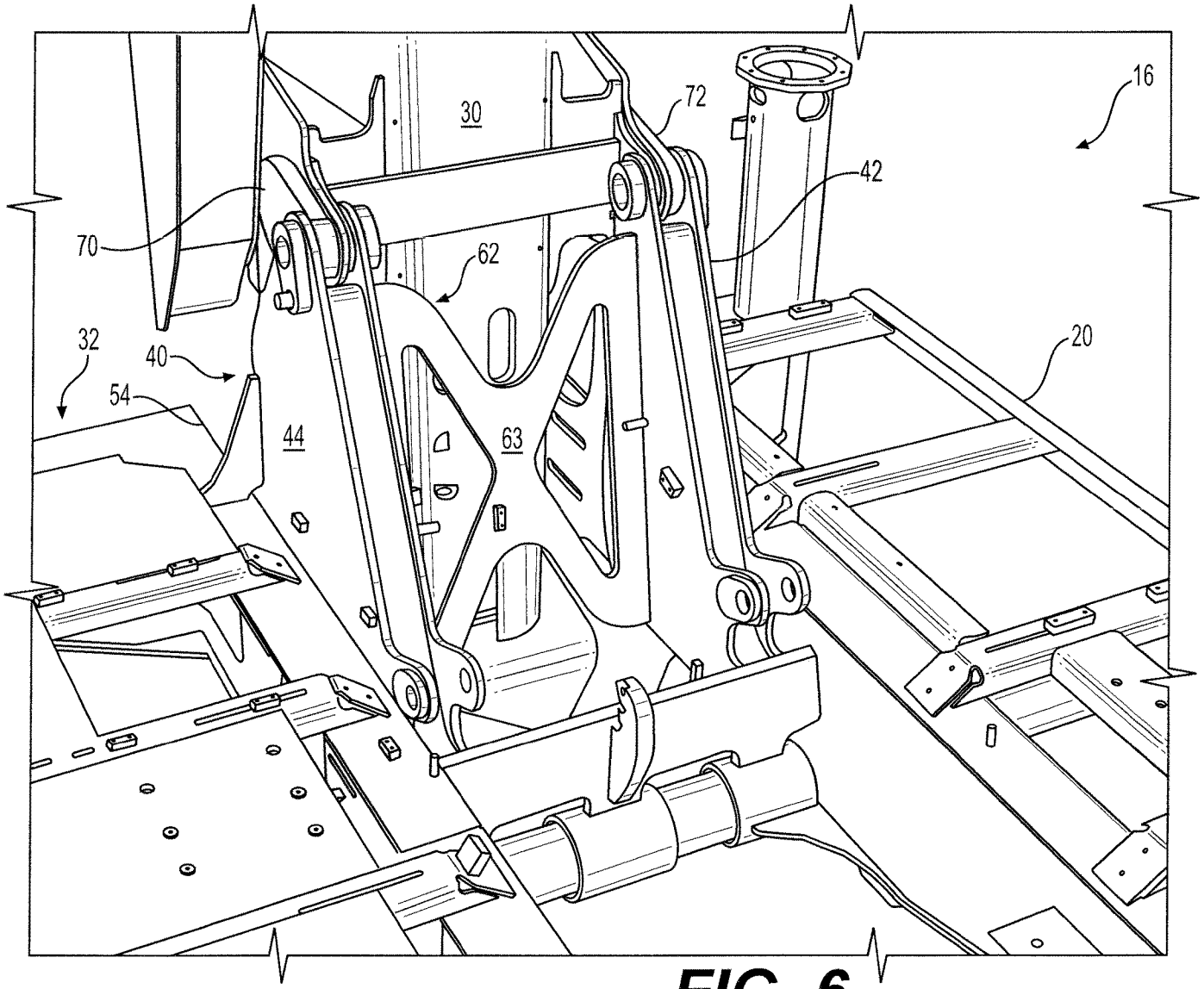
FIG. 6 is another perspective view of certain details of an exemplary platform based drill.

FIG. 6 is a further perspective view showing adjusting mechanism 40 viewed from a position on frame structure 20 of platform based drill 16. Mast 30 may be attached to pivotal connection 46 via pivot plates 70, 72, which may extend laterally from mast 30. See, for example, FIG. 2 illustrating pivot plate 72 extending to pivotal connection 46. As seen in FIG. 6, adjusting mechanism 40 is located within opening 54 at first end 32 of frame structure 20. Also visible in FIG. 6 is reinforcing framework 62 which may include a generally X-shaped reinforcing web 63 that extends between first and second adjustment plates 42, 44.

Figure 7:
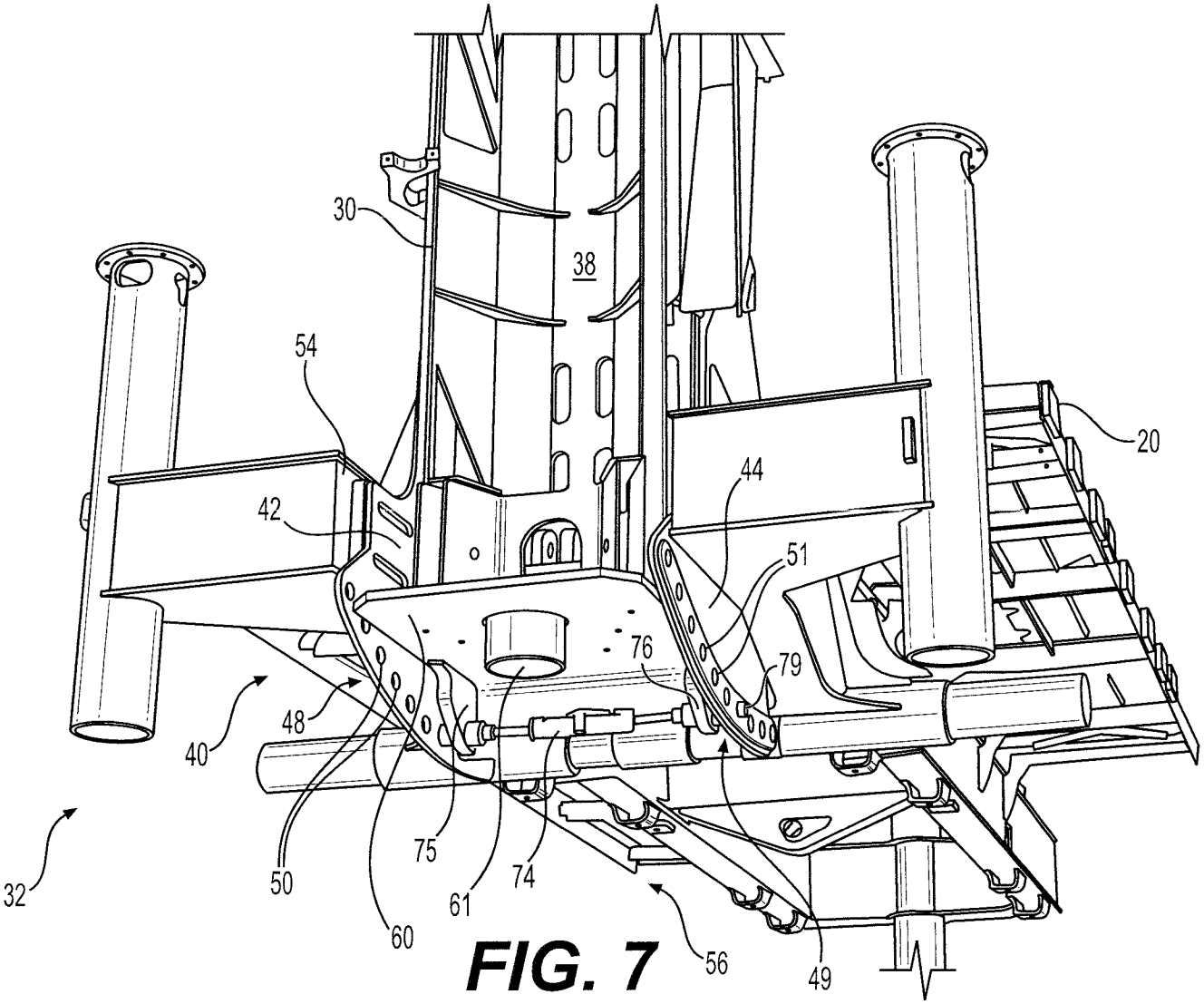
FIG. 7 is yet another perspective view of certain details of an exemplary platform based drill.

FIG. 7 is another perspective view from a position below frame structure 20 and looking toward first end 32 of frame structure 20. Mast 30 is illustrated in a substantially machine vertical orientation within opening 54 and between first and second adjustment plates 42, 44 of adjusting mechanism 40. Mast 30 may be generally C-shaped in cross-section with a concave inner surface 38 opening toward first end 32 of frame structure 20 and providing a space to receive drilling pipes or rods (not illustrated). Inner concave surface 38 also is visible in FIG. 3. Mast 30 may include baseplate 60 which in turn may include a centrally located aperture 61 within baseplate 60 through which drilling rods or pipes (not illustrated) may pass during a drilling process. As discussed previously in connection with FIG. 2, suitable structure associated with mast 30 may cooperate with adjustment apertures 50 of arcuate array 48 of first adjustment plate 42 and adjustment apertures 51 of arcuate array 49 of second adjustment plate 44 to lock mast 30 at a desired angle or position to which it has been pivoted. To that end, locking pin mechanism 74 may be located at lower portion 56 of mast 30, for example below baseplate 60, and may be supported via depending brackets 75, 76.

Locking pin mechanism 74 may cooperate with selected ones of adjustment apertures 50, 51 of arcuate arrays 48, 49 of first and second adjustment plates 42, 44 to lock mast 30 in an angular or vertical position to which it has been pivoted. For example, FIG. 7 illustrates a pin element 79 of locking pin mechanism 74 engaging one of apertures 51 of arcuate array 49. Referring back to FIG. 2, and also to FIG. 5, an adjustment aperture 50, 51 adjacent a first end 77 of third plate edge 47 may be positioned to permit mast 30 to be locked at a negative drilling angle $\alpha$ at least 15 degrees from vertical 17 with upper portion 31 of mast 30 leaning in a direction A that extends away from second end 34 of frame structure 20 and toward first end 32 of frame structure 20. An adjustment aperture 50, 51 adjacent second end 78 of third plate edge 47 may be positioned to permit mast 30 to be locked at a positive drilling angle at least 30 degrees from vertical 17 with upper portion 31 of mast 30 leaning in a direction B extending away from first end 32 of frame structure 20 and toward second end 34 of frame structure 20. Accordingly, adjusting mechanism 40 is configured to permit mast 30 to be adjusted to positive drilling angles of at least 30 degrees from a vertical position of mast 30, to a vertical position, and to a negative drilling angle of at least minus 15 degrees from a vertical position of mast 30.

Figure 8:
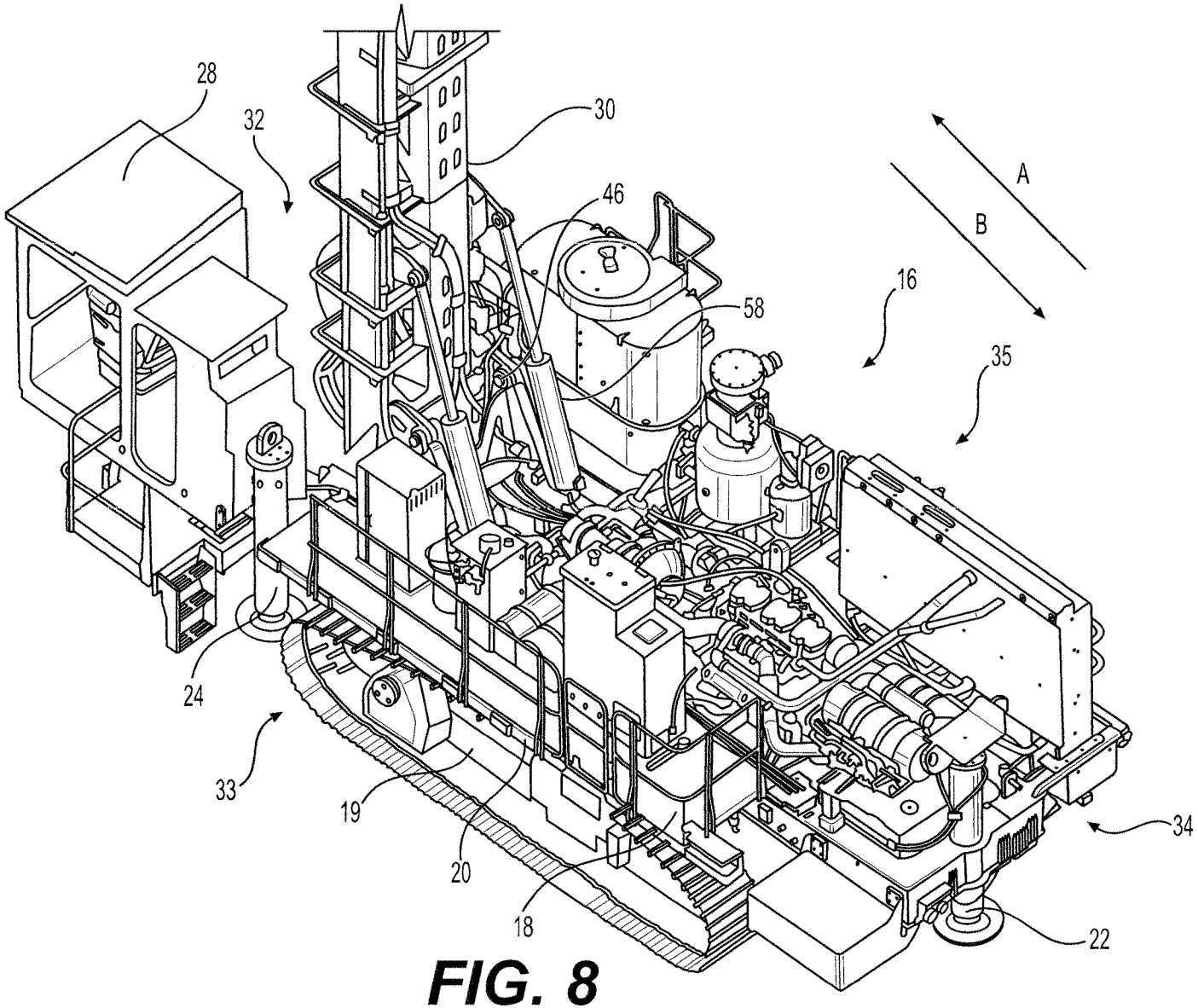
FIG. 8 is a perspective view of the general layout of an exemplary platform based drill.

FIG. 8 illustrates a general layout view in perspective of platform based drill 16 and shows aspects relevant to this disclosure and, by contrast to the stripped down versions illustrated in FIGS. 1 and 2, for example, generalized features generally associated with drilling operations. Platform based drill 16 may include suitable structure for transporting drilling platform 18 such as, for example, a tracked undercarriage 19. FIG. 8 illustrates the location of operator station 28 cantilevered at first end 32 and toward first side 33 of frame structure 20, giving an operator a position wherein the drilling operation and positioning of mast 30 can be closely observed. FIG. 8 illustrates mast 30 supported at first end 32 in a substantially machine vertical orientation. Pivoting of mast 30 to positive or negative angles via pivotal connection 46 may be accomplished using one or more actuators such as, for example, hydraulic cylinder actuator 58 connected between frame structure 20 and mast 30. Pivoting of mast 30 via hydraulic cylinder actuator 58 enables mast 30 to move to a position wherein, referring again to FIG. 7, locking pin mechanism 74 will be adjacent a selected adjustment aperture 50, 51 of arcuate arrays 48, 49 of adjustment plates 42, 44.

Figure 9:
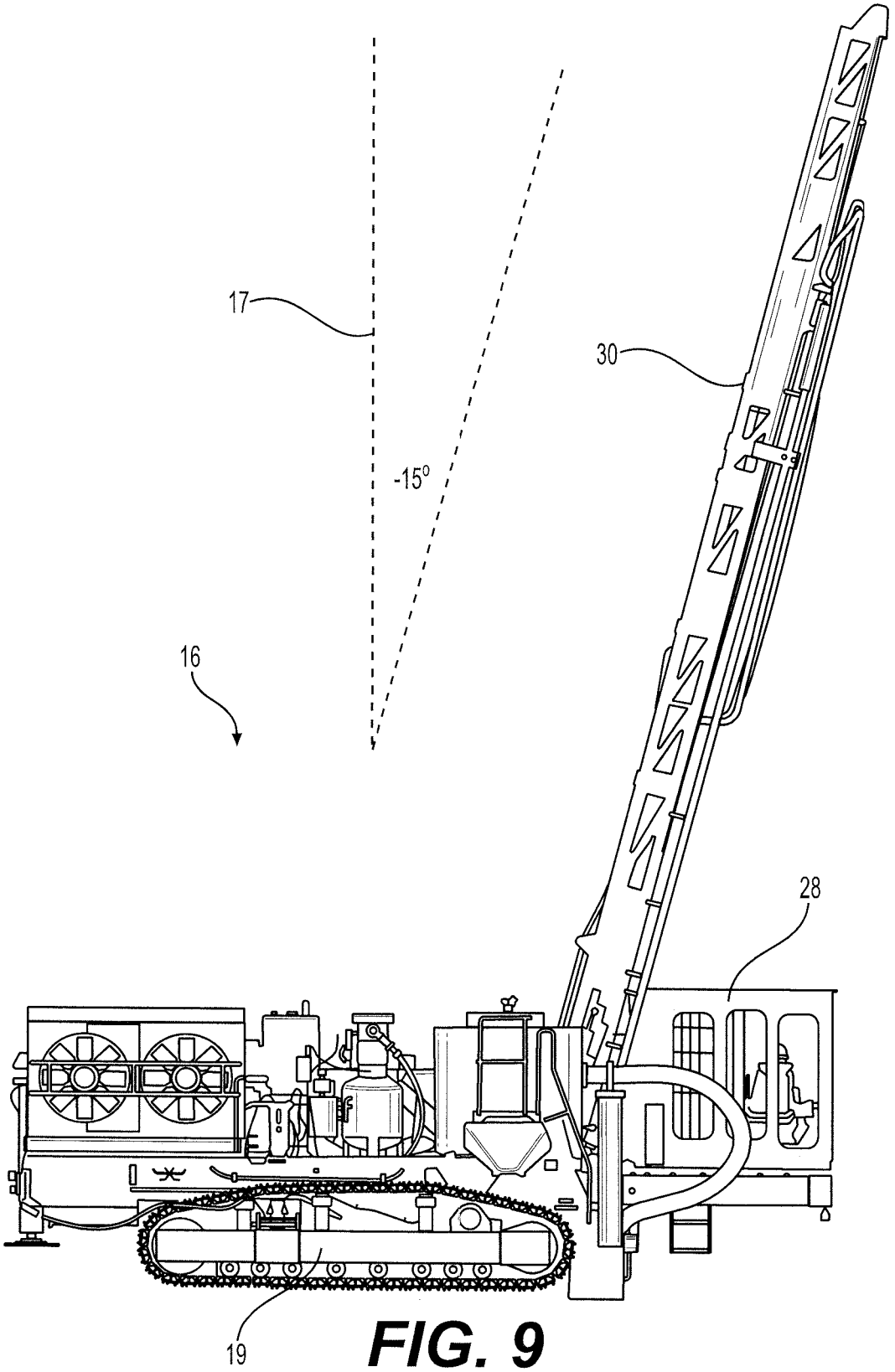
FIG. 9 is a side view of an exemplary platform based drill.

FIG. 9 is a side view of the platform based drill 16 of FIG. 8. Mast 30 is illustrated at a negative angle of −15 degrees from vertical 17. In the orientation illustrated in FIG. 9, platform based drill 16 may readily be positioned adjacent highwall 14 (FIG. 1) for drilling pre-split holes, such as pre-split hole 36 illustrated in FIG. 1, at the angle of 15 degrees. Advantageously, platform based drill 16 also may be readily repositioned to drill buffer holes and/or production holes.

INDUSTRIAL APPLICABILITY

Disclosed embodiments of platform based drill 16 capable of negative angle drilling may be applicable to drill-and-blast operations such as those employed in mines, quarries and other excavations. The disclosed platform based drill 16 capable of negative angle drilling offers distinct advantages over existing equipment used in drill-and-blast operations where drilling both pre-split and production holes ordinarily requires separate, high-cost machines. Because disclosed platform based drill 16 is capable of drilling vertical holes, positive angle holes, and negative angle holes, it is advantageously able to form both pre-split holes at the required proximity to the highwall and angle that is substantially parallel to the slope angle of the highwall of a mine, quarry, or other excavation, as well as able to form the typically larger diameter production holes conventionally formed by platform based drilling equipment. A major beneficial advantage of disclosed platform based drill 16 capable of negative angle drilling is the elimination of the required separate types of machines for drilling the pre-split holes (e.g., boom mounted drilling equipment of down-the-hole (DTH) or top hammer configurations), and for drilling other holes such as production holes.

Figure 10:
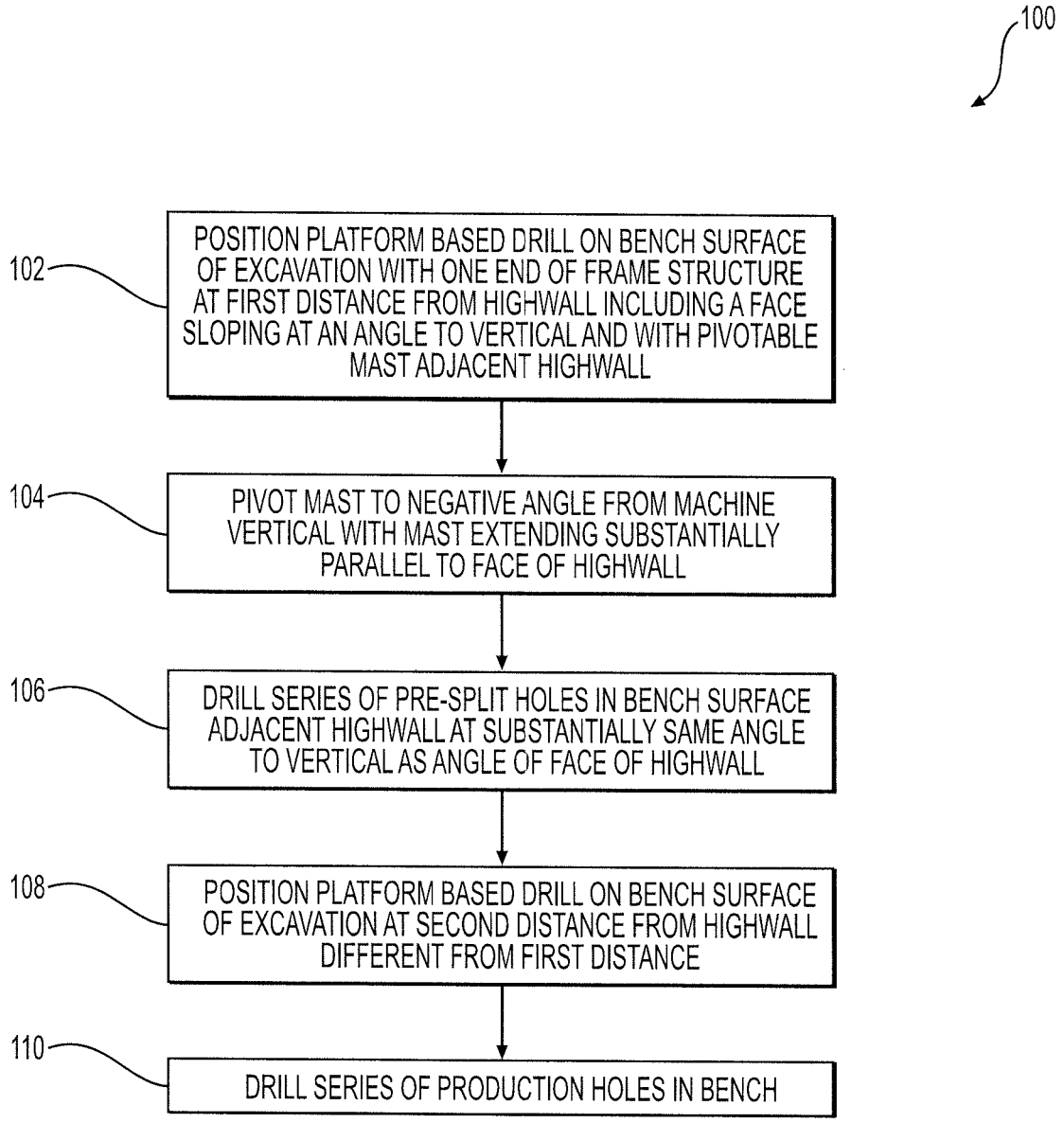
FIG. 10 is a flow chart for an exemplary method according to the disclosure.

An exemplary method of drilling with a platform based drill according to the disclosure wherein the platform based drill includes a frame structure with a pivotable mast mounted at one end of the frame structure is diagrammatically illustrated via flowchart 100 in FIG. 10. Referring to FIG. 10, the exemplary method may include, at box 102, positioning the platform based drill on a bench surface of an excavation with the one end of the frame structure at a first distance from the highwall of the excavation and with the pivotable mast adjacent the highwall, the highwall including a face sloping at an angle to vertical.

At box 104, the mast may be pivoted to achieve a negative angle from machine vertical with the mast extending substantially parallel to the face of the highwall. The pivoting of the mast to achieve a negative angle from machine vertical may include pivoting the mast between first and second adjustment plates, with each adjustment plate including pivot apertures for the mast and each adjustment plate including an arcuate array of adjustment apertures. The mast may be locked at a selected negative angle by inserting a locking pin into a selected adjustment aperture of each arcuate array.

At box 106, a series of pre-split holes may be drilled in the bench surface adjacent the highwall at substantially the same negative angle to vertical as the angle of the face of the highwall. At box 108, the platform based drill may be positioned on the bench surface of the excavation at a second distance from the highwall different from the first distance. At box 110, a series of production holes may be drilled in the bench. Before drilling the series of production holes, the mast may be pivoted to a vertical position and the production holes may be drilled with diameters larger than a diameter of the pre-split holes.

It will be apparent to those skilled in the art that various modifications and variations can be made in the disclosed platform based drill capable of negative angle drilling without departing from the scope of the disclosure. Other embodiments of the disclosed platform based drill capable of negative angle drilling will be apparent to those skilled in the art from consideration of the specification. It is intended that the specification and examples be considered as exemplary only, with a true scope of the disclosure being indicated by the following claims and their equivalents.

What is claimed is:

1. A platform based drill, comprising:

a drilling platform including a frame structure having a first end, a second end opposite the first end, and first and second opposite sides;

a mast supported on a pivotal connection to the drilling platform adjacent the first end of the frame structure and including an upper portion extending above the pivotal connection, and a lower portion extending below the pivotal connection; and an adjusting mechanism configured to permit the mast to be pivotally adjusted to a negative drilling angle whereby the upper portion of the mast leans in a direction extending away from the second end of the frame structure and toward the first end of the frame structure, wherein the adjusting mechanism includes a first adjustment plate secured to the frame structure adjacent to the mast, and wherein the first adjustment plate includes a first pivot aperture at a first upper portion of the first adjustment plate, and a first plurality of adjustment apertures at a first lower portion of the first adjustment plate.

2. The platform based drill of claim 1, wherein the adjusting mechanism also is configured to permit the mast to be adjusted to angles other than a negative drilling angle and to a vertical position.

3. The platform based drill of claim 2, wherein the adjusting mechanism is configured to permit the mast to be adjusted to a negative drilling angle of at least minus 15 degrees from a vertical position of the mast and to a positive drilling angle of at least 30 degrees from a vertical position of the mast.

4. The platform based drill of claim 1, wherein the first end of the frame structure includes an opening extending into the drilling platform centrally between the first and second opposite sides, and wherein the mast is pivotally mounted within the opening.

5. The platform based drill of claim 4, including at least one hydraulic actuator extending between the frame structure and the mast to pivotally adjust the mast.

6. The platform based drill of claim 5, wherein the adjusting mechanism includes a second adjustment plate secured to the frame structure adjacent to the mast, wherein the first adjustment plate is substantially parallel to the second adjustment plate, and wherein the mast is pivotally mounted between the first and second adjustment plates.

7. The platform based drill of claim 6, wherein the second adjustment plate includes a second pivot aperture at a second upper portion of the second adjustment plate, and a second plurality of adjustment apertures at a second lower portion of the second adjustment plate.

8. The platform based drill of claim 1, further including an operator station adjacent the first end of the frame structure and adjacent one of the first and second sides, and wherein the operator station is cantilevered from the frame structure.

9. The platform based drill of claim 1, including a tracked undercarriage for transporting the drilling platform, and a plurality of vertically adjustable supports for leveling and supporting the drilling platform.

10. A platform based drill, comprising:

a drilling platform including a frame structure having a first end, a second end, a first side, and a second side;

an opening within the frame structure at the first end centrally between the first side and the second side and extending into the drilling platform;

a mast extending within the opening and including an upper portion and a lower portion;

an adjusting mechanism configured to permit adjustment of the mast to a negative drilling angle whereby the upper portion of the mast leans in a direction extending away from the second end of the frame structure and toward the first end of the frame structure, the adjusting mechanism including first and second adjustment plates within the opening and fixed to the frame structure; and a pivotal connection between the mast the first and second adjustment plates, wherein each of a first bottom portion of the first adjustment plate and a second bottom portion of the second adjustment plate has a plurality of adjustment apertures, and wherein the pivotal connection is provided at a height above the plurality of adjustment apertures of the first bottom portion of the first adjustment plate and the second bottom portion of the second adjustment plate.

11. The platform based drill of claim 10, wherein the opening includes two parallel side edges, and wherein one of the first and second adjustment plates is mounted to one of the two side edges, and the other of the first and second adjustment plates is mounted to the other of the two side edges.

12. The platform based drill of claim 11, wherein each of the first and second adjustment plates includes first and second plate edges converging upwardly to a pivot aperture, and a third plate edge extending between the first and second plate edges and including an arcuate array of adjustment apertures extending between a first end of the third plate edge and a second end of the third plate edge.

13. The platform based drill of claim 12, wherein the arcuate array of adjustment apertures of each of the first and second adjustment plates is on an arc that is centered at the pivot aperture.

14. The platform based drill of claim 13, wherein the pivot aperture of each of the first and second adjustment plates is above the frame structure, and the arcuate array of adjustment apertures of each of the first and second adjustment plates is below the frame structure.

15. The platform based drill of claim 14, wherein the mast includes a locking pin mechanism adjacent the first and second adjustment plates and configured to cooperate with a selected adjustment aperture of the arcuate array, and at least one actuator extending between the frame structure and the mast for pivoting the mast to a position wherein the locking pin mechanism is adjacent the selected adjustment aperture.

16. The platform based drill of claim 15, wherein an adjustment aperture adjacent a first end of the third plate edge is positioned to permit the mast to be locked at a negative drilling angle at least 15 degrees from a vertical position of the mast with the upper portion of the mast leaning in a direction extending away from the second end of the frame structure and toward the first end of the frame structure, and an adjustment aperture adjacent the second end of the third plate edge is positioned to permit the mast to be locked at a positive drilling angle at least 30 degrees from a vertical position of the mast with the upper portion of the mast leaning in a direction extending away from the first end of the frame structure and toward the second end of the frame structure.

17. The platform based drill of claim 10, including a reinforcing framework extending between the first and second adjustment plates, and wherein each adjustment plate includes a pivot aperture at an upper portion of the adjustment plate above the frame structure and an arcuate array of adjustment apertures at a lower portion of the adjustment plate below the frame structure.

18. A method of drilling with a platform based drill, the platform based drill including a frame structure with a pivotable mast mounted at one end of the frame structure, the method comprising:

positioning the platform based drill on a bench surface of an excavation with the one end of the frame structure at a first distance from a highwall of the excavation and with the pivotable mast adjacent the highwall, the highwall including a face sloping at an angle to vertical;

pivoting the mast to achieve a negative angle from machine vertical with the mast extending substantially parallel to the face of the highwall;

drilling a series of pre-split holes in the bench surface adjacent the highwall at substantially the same angle to vertical as the angle of the face of the highwall;

positioning the platform based drill on the bench surface of the excavation at a second distance from the highwall different from the first distance; and drilling a series of production holes in the bench.

19. The method of claim 18, further including, before drilling the series of production holes, pivoting the mast to a vertical position and drilling the production holes with diameters larger than a diameter of the pre-split holes.

20. The method of claim 18, wherein pivoting the mast to achieve a negative angle from machine vertical includes pivoting the mast between first and second adjustment plates each including pivot apertures for the mast and each including an arcuate array of adjustment apertures, further including:

locking the mast at a selected negative angle by inserting a locking pin into a selected adjustment aperture of each arcuate array.

* * * * *